US007382215B1

(12) United States Patent
Schaffner

(10) Patent No.: US 7,382,215 B1
(45) **Date of Patent: *Jun. 3, 2008**

(54) IMAGE GUIDE COUPLER SWITCH

(75) Inventor: James H. Schaffner, Chatsworth, CA (US)

(73) Assignee: HRL Laboratories, LLC, Malibu, CA (US)

( * ) Notice: Subject to any disclaimer, the term of this patent is extended or adjusted under 35 U.S.C. 154(b) by 5 days.

This patent is subject to a terminal disclaimer.

(21) Appl. No.: 11/504,848

(22) Filed: Aug. 15, 2006

Related U.S. Application Data

(62) Division of application No. 11/030,789, filed on Jan. 7, 2005, now Pat. No. 7,109,823.

(51) Int. Cl.
*H01P 5/18* (2006.01)
*H01P 1/10* (2006.01)

(52) U.S. Cl. ..... 333/113; 333/108; 333/258

(58) Field of Classification Search ..... 333/101, 333/103, 105, 108, 109, 113, 258
See application file for complete search history.

(56) References Cited

U.S. PATENT DOCUMENTS

| | | | |
|---|---|---|---|
| 4,885,589 | A | 12/1989 | Edward et al. |
| 6,144,267 | A | 11/2000 | Saitoh et al. |
| 6,269,273 | B1 | 7/2001 | Miller et al. |
| 6,614,332 | B2 | 9/2003 | Yamashita et al. |
| 6,788,918 | B2 | 9/2004 | Saitoh et al. |

OTHER PUBLICATIONS

E.A.J. Marcatili, Dielectric Rectangular Waveguide and Directional Coupler for Integrated Optics, The Bell System Technical Journal pp. 2071-2102 (Sep. 1969).

H. Kogelnik and R.V. Schmidt, Switched Directional Coupleers ith Alternating Deltabeta,IEEE Journal of Quantoum Electronics, vol. QE-12, No. 7, pp. 396-401 (Jul. 1976).

K.J.Button and J.C. Wiltse, Dielectric Waveguide-Type Millimeter-Wave Integrated Circuits, Infrared and Millimeter Waves, vol. 4,Ch. 5 Millimeter Systems, pp. 199-273 (1981).

Y. Shih, et al, Directive Planar Excitation of an Image Guide, IEEE Department of Electrical Engineering, The University of Texas, Austin, Texas, pp. 5-7 (1981).

J.A. Encinar, et al., Theoretical and Experimental Results for Metal-Strip-Loaded Image-Guide Antennas, Universal Politecnica de Madrid, Spain, p. 917.

P. Kwan and C.Vittoria, Scattering Parameters Measurement of a NOnreciprocal Coupling Structure, IEEE Transactions on Microwave Theory and Tech., 41 No. 4, pp. 652-657 (Apr. 1993).

Ke Wu and Liang Han, Hybrid Integration Technology of Planar Circuits and NRD-Guide for Cost-Effective Microwave and Millimeter-Wave Applications, IEEE Transactions on Microwave Theory and Tech., vol. 45 No. 6 p. 946-954 (Jun. 1997).

*Primary Examiner*—Dean Takaoka
(74) *Attorney, Agent, or Firm*—Christopher R. Balzan, Esq.

(57) ABSTRACT

In one implementation, a method is provided for an image guide coupler. The method includes controlling a coupling between adjacent waveguides of a propagating wave by controlling a coupling through at least one field pick up probe positioned next to the adjacent waveguides. In some implementations, controlling the coupling through the at least one field pick up probe includes using a series connected switch. In some implementations, the method includes controlling the coupling through the at least one field pick up probe using a pin diode, a transistor, a MEMS switch, or a varactor, in series with the at least one field pick up probe.

38 Claims, 5 Drawing Sheets

IMAGE GUIDE COUPLER SWITCH

CROSS REFERENCE TO RELATED APPLICATION

This application is a divisional of U.S. application Ser. No. 11/030,789, by James H. Schaffner, filed Jan. 7, 2005, now U.S. Pat. No. 7,109,823 issued Sep. 16, 2007, entitled IMAGE GUIDE COUPLER SWITCH, herein incorporated by reference in its entirety.

BACKGROUND

At very high frequencies, 30 to 300 GHz for millimeter wave frequency band, typical integrated circuit transmission lines, such as microstrip or coplanar waveguide, become very lossy due to conductor and dielectric losses, and metal and substrate surface irregularities which can cause unwanted reflections and radiation. At these high frequencies, dielectric waveguides, of which there are a number of different forms provide a lower loss alternative to signal routing.

Conventional dielectric waveguide switches require a transition from the dielectric waveguide to a transmission line which leads to a localized switch circuit. Typical transmission lines have a metal strip on the top side of the circuit substrate and a metal ground on the bottom of the circuit substrate, or coplanar waveguide which has a signal strip on the top side of the substrate and two metallic grounds also on the substrate top-side which are separated on each side of the strip by a gap which is determined by the desired characteristic impedance of the line. These transitions are typically necessary to connect the image guide to sources, mixers, amplifiers, and switching, but they degrade the overall performance of the image guide system through parasitic reflections and radiation which increase as the frequency of the system increases.

At very high frequencies, these transitions and transmission lines add RF loss to the overall dielectric waveguide circuit. So, at very high frequencies, 30 Ghz and up, switches tend to be either very lossy or narrow band. What is needed is a high frequency switch that provides signal switching without having to remove the signal from the dielectric waveguide. Also, what is needed is a means to avoid the RF losses associated with metallic transmission lines at higher frequencies. Furthermore, what is needed is a device that does not require a transition from dielectric waveguide to printed circuit transmission line. This is particularly true in high frequency applications.

One alternative approach utilizes an image guide coupler. In this approach, a ferrite is placed between the image guides along the coupling region as disclosed in an article by P. Kwan and C. Vittoria, entitled "Scattering Parameters Measurement of a Nonreciprocal Coupling Structure," in *IEEE Trans. Microwave Theory Technique*, Vol. 41, No. 4, April 1993, pp. 652-657. A magnetic field bias applied to the ferrite controls the coupling between the image lines. Thus, the coupling coefficient is modified by an external applied magnetic field bias on the ferrite for isolators, filters, modulators, switches, and phase shifters. With appropriate external applied magnetic field bias on the ferrite, the four port device prior art can be made into an image guide switch.

With such an approach, however, there are several problems. One problem is that ferrites become lossy at high frequency. What is need is a high frequency switch capable of providing low loss. Another problem is that ferrites are not easy to integrate into monolithic structures. Thus, there is a need for a switch capable of easy integration into monolithic integrated circuit structures.

SUMMARY

In one embodiment, a system is provided which includes an antenna and an antenna support structure. The support structure includes a dielectric image guide coupler and a coupling control circuit. The coupling control circuit includes at least one field pick up probe extending adjacent the image guide coupler and a switch connected in series with the at least one field pick up probe and a dielectric waveguide of the dielectric waveguide image guide coupler. The coupling control circuit further includes control logic electronics connected to the switch for controlling the switch. In some embodiments the system may further include a capacitor connected in series with the switch.

In another embodiment, a system is provided which includes an antenna and an antenna support structure. The antenna support structure may include waveguides having an active region for coupling electromagnetic radiation and a coupling control circuit adjacent the active region. In this embodiment, the coupling control circuit includes at least one field pick up probe adjacent the active region and a variable capacitor means connected in series with the at least one field pick up probe. Control logic electronics is connected to the variable capacitor means. In some embodiments, the variable capacitor means may include at least one switch and series connected capacitor. In other embodiments, the variable capacitor means may include at least one varactor.

In one implementation, a method is provided for an image guide coupler. The method includes controlling a coupling between adjacent waveguides of a propagating wave by controlling a coupling through at least one field pick up probe positioned next to the adjacent waveguides. In some implementations, controlling the coupling through the at least one field pick up probe includes using a series connected switch. In some implementations, the method includes controlling the coupling through the at least one field pick up probe using a pin diode, a transistor, a MEMS switch, or a varactor, in series with the at least one field pick up probe.

In some implementations, a method for controlling the coupling between adjacent waveguides which includes controlling a capacitance between the adjacent waveguides using the at least one field pick up probe is provided. This may include switching to connect a capacitor in series with the at least one field pick up probe. This may include using a pin diode, a transistor, a MEMS switch, or a varactor, in series with the at least one field pick up probe.

BRIEF DESCRIPTION OF THE DRAWINGS

The features and advantages of the present invention will be better understood with regard to the following description, appended claims, and accompanying drawings where:

DESCRIPTION

Figure 1:
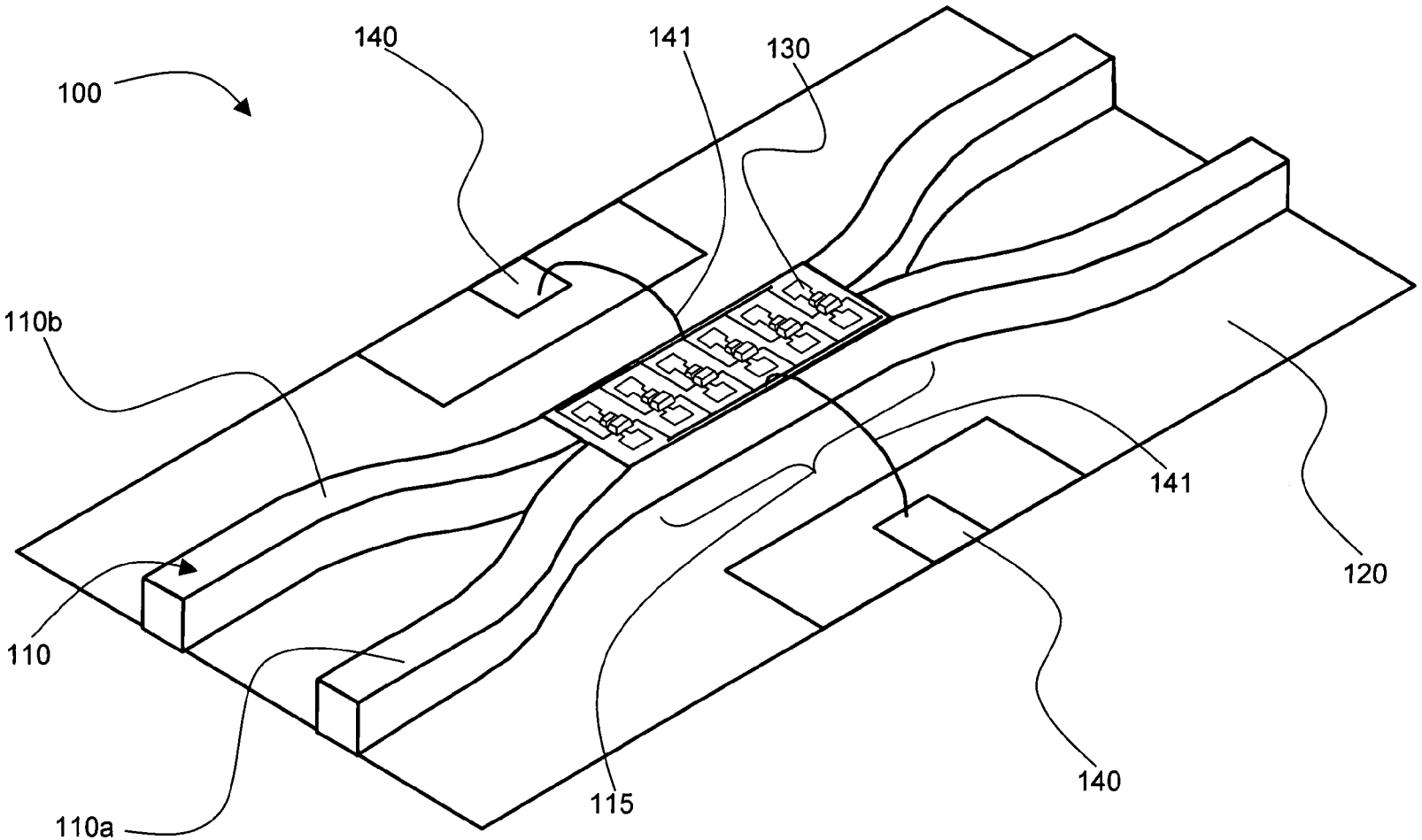
FIG. 1 shows a perspective view of an image guide coupler switch in accordance with one embodiment of the present invention.

FIG. 1 shows a perspective view of an image guide coupler switch 100 in accordance with one embodiment of the present invention. An image guide coupler 110 has two waveguides 110*a* and 110*b*, which may be dielectric rods or bars, located on a ground plane 120. Waveguides 110*a* and 110*b* can be machined, molded, or formed by masking, depositing and/or etching techniques, depending on the material used and the particular application. A number of low-loss dielectric materials exist from which the dielectric waveguides 110*a* and 110*b* can be made. For example materials such as Rexolite® (produced by C-Lec Plastics, Inc. of Philadelphia, Pa.), Hi-K material (such as produced by Emerson & Cuming, located in Randolf, Mass.), fused silica, Teflon®, ceramics, and even high resistivity semiconductors such as semi-insulating GaAs.

Typically, the image guide coupler 110 is partially surrounded by air so it can support propagating electromagnetic modes. (In the embodiment of FIG. 1, the metallic ground plane 120 provides a base for the image guide coupler 110, and a low-loss metallic structure for the lowest order waveguide mode in the image guide coupler 110. The metallic ground plane 120 may be made from a solid metal slab, or from metal deposited on a semiconductor or insulating substrate.

Since the image guide coupler 110 is not completely surrounded by metal, some of the guided field is located physically outside of waveguide 110*a* or 110*b*, in which it is traveling. The waveguides 110*a* and 110*b* are brought into close proximity at a coupling region 115 so that an electromagnetic field traveling in one waveguide 110*a* has some field overlap within the other waveguide 110*b*. The result is that energy can be transferred from one line to the other, over a given interaction length, as in an image guide coupler. The length of the waveguides 110 of the image guide coupler in the coupling region 115 is such that signal crosses over at the end of the coupling region 115. Further, the guides are close enough together so the evanescent field, which extends outside the one guide, will extend into the other guide. If the guide is too long the signal will sinusoidally flip-flop. In one embodiment, discussed below, the length of the waveguides 110*a* and 110*b* are selected so that there is complete cross over coupling from one guide to the other as a result of the natural evanescent field extending into the adjacent waveguide at the coupling region 115. The separation between the waveguides 110*a* and 110*b* is increased beyond the coupling region 115 so that they do not couple any longer. The strength of the coupling depends upon the proximity of the waveguides 110*a* and 110*b*, and how confined the fields are within the waveguides, i.e. the waveguide material and the surrounding medium.

Figure 2:
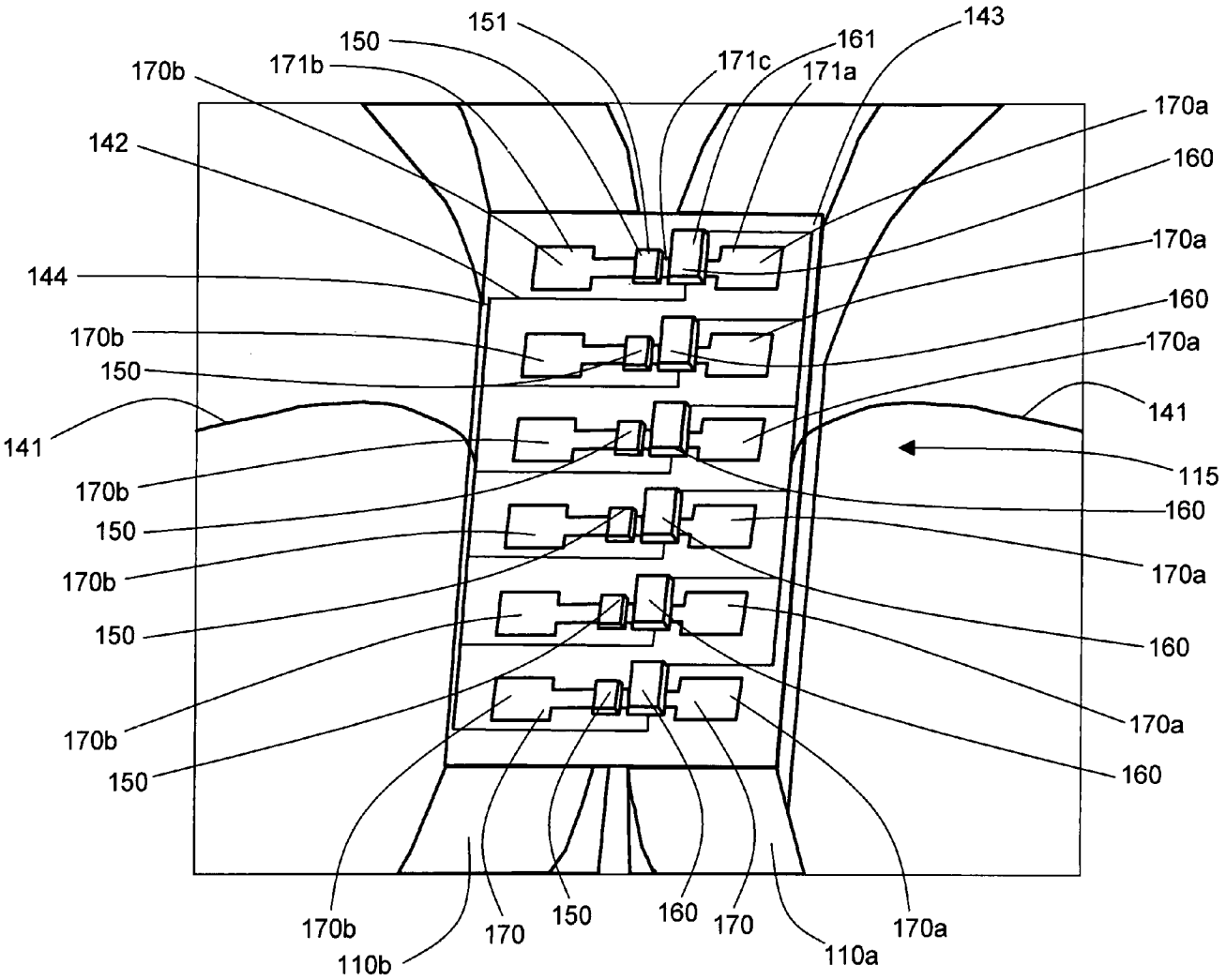
FIG. 2 shows an enlarged perspective view of the coupling region of FIG. 1 in accordance with one embodiment of the present invention.

Coupling control circuitry 130 is positioned adjacent to the image guide coupler 110, and is used to influence the coupling of the image guide coupler 110. FIG. 2 shows an enlarged perspective view of the coupling region 115 of FIG. 1 in accordance with one embodiment of the present invention. An array of capacitors 150, which may be switched using switches 160, are shown straddling the two waveguides 110*a* and 110*b*. The array of capacitors 150 are shown above the coupling region 115, where the two waveguides 110*a* and 110*b* are in close proximity. Field pick-up probes 170 extend over the two guides 110*a* and 110*b*. The field pick-up probes 170 may be a metal such as copper, or an other transmissive material.

The capacitor array 150, as well as the field pick-up probes 170, can be constructed on a very thin (approximately 25 micrometers) layer of Kapton®, which straddles the two waveguides 110*a* and 110*b* and adheres to the tops of the waveguides 110*a* and 110*b*. Kapton® is available from DuPont, of Circleville, Ohio, www.dupont.com. Other printed circuit board substrates could also be used, but the capacitance values and spacing would need to be tailored for the specific substrate parameters.

The coupling control circuit 130 includes a pair of electric field pick-up probes 171*a* and 171*b*, which are connected to a series circuit having a capacitor 151 and a switch 161. The capacitor 151 and the switch may be integrally formed, or be separate structures interconnected by a segment 171*c* between the capacitor 151 and the switch 161. The capacitor may be a chip capacitor and the switch 161 could be pin a diode, transistor, MEMS switch, etc. Bias lines 142 and 143 may be used to actuate the switch 161. The coupling control circuit may have a single capacitor 151 and switch 161 connected between a pair of field probes 171*a* and 171*b*. In some embodiments as shown in FIG. 2, the coupling control circuit 130 may have an array of electric field pick-up probes 170*a* and 170*b*. In such an embodiment, all switches 160 of the array may be turned on together. To facilitate this, the positive bias lines of each switch can be connected to a common bus line 144, while the negative bias lines can be connected to a common bus line 145. Wires 141 can lead from these bus lines 144 and 145 to respective bias control pads 140 which are located away from the image guide coupler, as shown in FIG. 1.

When the switches 160 are not actuated there is an effective open circuit between the two field pick-up probes 171*a* and 171*b*. In this case coupling between the two waveguides 110*a* and 110*b* occurs only from the overlap of the electric field of one waveguide with the dielectric from the other waveguide. When the waveguides 110*a* and 110*b* are in close proximity, energy is continually transferred from one waveguide to the other. If the two waveguides 110*a* and 110*b* have identical cross sectional dimensions, at a particular length, known as the coupling length, all of the signal from the propagating mode of one guide will transfer completely to the propagating mode of the other guide. This coupling length depends upon the frequency of the signal, the dielectric constant of the image guide material, and the separation between the guides. These factors can be determined from measurements, or from simulation software, such as Ansoft HFSS®, Asoft Corp., Pittsburg, Pa., www.ansoft.com.

In some embodiments, the cross-over of energy occurs when the switches 160 are not actuated, that is when they are open circuited. This is known as the "cross" state. When the switches are turned on, the coupling between the two waveguides 110*a* and 110*b* in the coupling region 115 is enhanced. The field pick-up probes 170*a* and 170*b* are now electrically connected together, so that RF current can flow between the field pick-up probes 170*a* and 170*b*. Thus, current induced in the field pick-up probes 170*a* and 170*b* from the propagating field in one of the image guides, in turn induces a propagating field in the other image guide. Most of the field transfer between the image guides still occurs from the close proximity of the waveguides 110, however, the now connected field pick-up probes 170*a* and 170*b* enhances this coupling by a small amount at each member of the array.

By arranging pick-up probes 170*a* and 170*b*, switches 160, and capacitors 150 in an array down the coupling region, enhanced coupling is distributed along the length of the active region 115 image guide coupler. The amount of coupling is dependent upon the location and shape of the field pick-up probes 170*a* and 170*b* and the capacitance of each switch and capacitor 150 and 160, and the distance between each switch 160 and capacitor 150. For the above embodiment, the effective coupling coefficient in this case is large enough to allow the RF mode from one guide cross over to the other guide and then back to the original guide in one cross-over coupling length. This is known as the "bar" state of the coupler. Thus, if the two waveguides 110*a* and 110*b* are identical and if the coupling region is long enough, energy will couple completely from one guide 110*a* to the other 110*b*, and then couple back to the original guide 110*a*. Again, simulation or measurements can be used to determine the parameters for this switch/capacitor array. Thus, a coupling control circuit 130 is provided between the "cross" and "bar" states which is controlled by a voltage applied to the array switches 160.

When the capacitor array 150 is switched "on", the coupling is enhanced, which causes the electromagnetic energy to cross into the other guide and then back into the original guide in the coupling length. When the capacitor array 150 is switched "off" the energy crosses into the other guide, but does not cross back to the original guide. Thus, the image guide coupler switch 100 acts as a switch for the electromagnetic wave between the two waveguide outputs.

Six switches 160 and capacitors 150 shown are arrayed in FIG. 2, although the exact number required for the switching function to occur may be determined through simulation and/or experiments. Furthermore, although shown as an array, it is possible in some embodiments to provide single combined components, i.e. a single capacitor, switch, or pair of probes, if desired. As discussed below, however, one advantage in an array of capacitors 150 and/or switches 160 is that power dissipation is distributed through the array. In some embodiments (not shown), it is possible to omit the capacitor or array of capacitors 150 from the coupling control circuit 130. In such an embodiment, however, the inductance of the field pick-up probes and switch(es) would have to be low enough for high frequency applications. The capacitor array discussed above, effectively increases the dielectric constant between the two dielectric guides which increases the coupling between the two waveguides. Thus, some embodiments control of the coupling coefficient is achieved using a switched capacitor array which is located proximate to the two guides. In some embodiments, the capacitor could be a gap, or an array of gaps between the pick-up probes. In certain other embodiments, the capacitor, or the capacitor array 150 may be completely omitted from the coupling control circuit 130, with the field pick up probes 170 being connected via switches 160.

Several embodiments of the present invention allow lower power losses. Because the entire energy of the field is not coupled through the coupling control circuit 130, losses are reduced. There is little loss in the field pick-up probes, switches and/or capacitors since most of the field density remains in the dielectric waveguide. In this respect the field pick-up probes, the switch and/or capacitor array forms a perturbation to the electromagnetic properties of the image guide coupler.

The bias lines 142 and 143 may be fabricated small to provide high inductance to ensure that RF energy is not lost in the switch bias lines. The pick-up probes 170*a* and 170*b* are larger to have low inductance. The size of the pick-up probes 170*a* and 170 is dependent on frequency of operation.

In alternate embodiments not shown, a high frequency varactor diodes could replace the capacitor and switch combination in the coupling control circuit. Thus a single varactor, or an array of varactors could be used.

Figure 3:
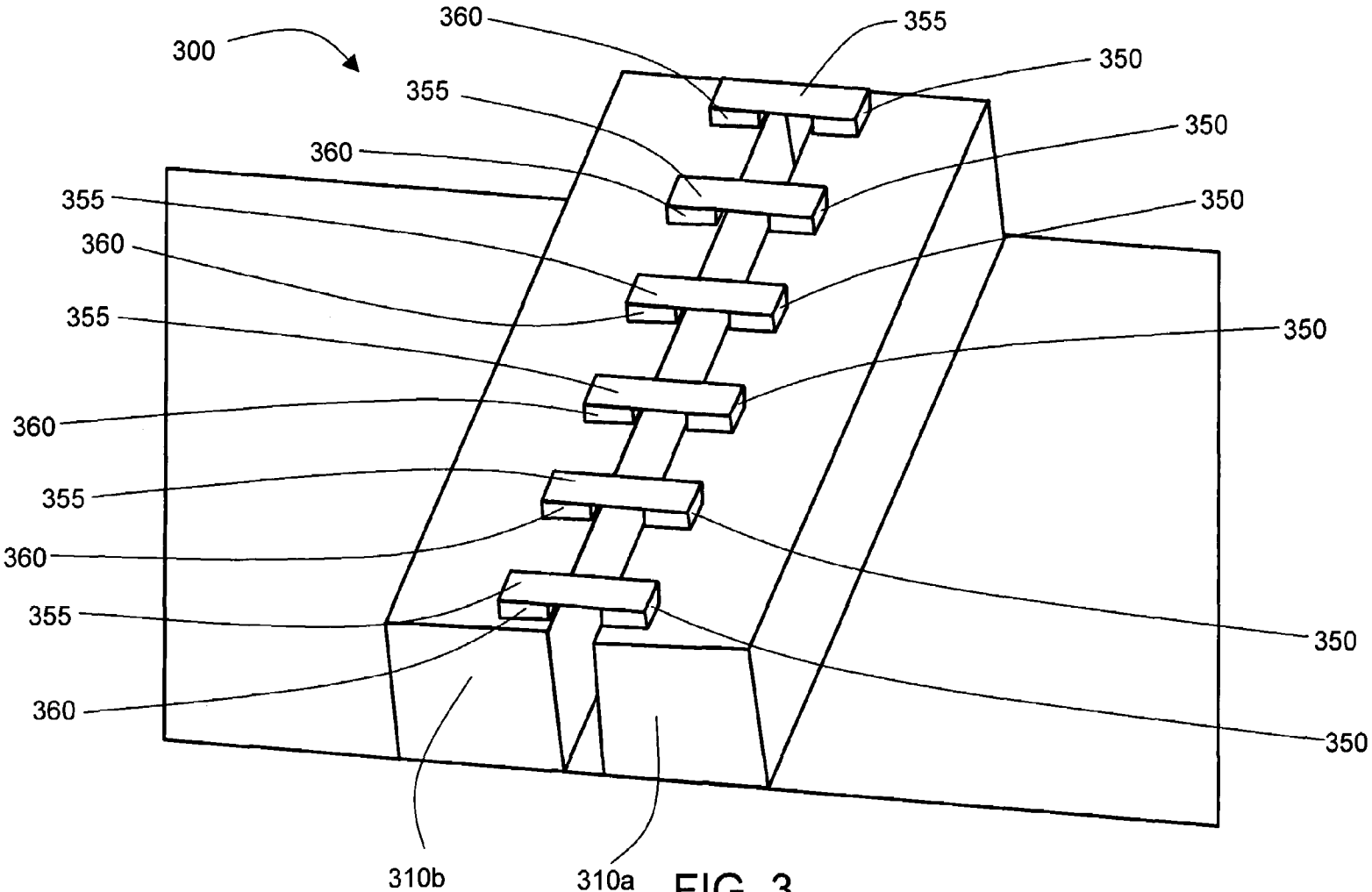
FIG. 3 shows a perspective view of an alternate embodiment of the coupling region of the image guide coupler switch.

FIG. 3 shows a perspective view of an alternate embodiment of the coupling region 315 of the image guide coupler switch 300. In the embodiment shown, the capacitors 350 and the switches 360 contact the waveguides 310*a* and 310*b*, respectively. Interconnect segments 355 connect the capacitors 350 with the switches 360 across the space separating the waveguides 310*a* and 310*b*. The interconnect segments 355 may be conductor material and function as a field pick up probe. Or, in other embodiments the interconnect segments 355 may be a dielectric material. In yet other embodiments (not shown), the capacitors may be omitted, depending on the application. Not shown in FIG. 3 is the interconnect circuitry and control logic for the switches 360, as FIG. 3 is a simplified illustration for example purposes.

Figure 4:
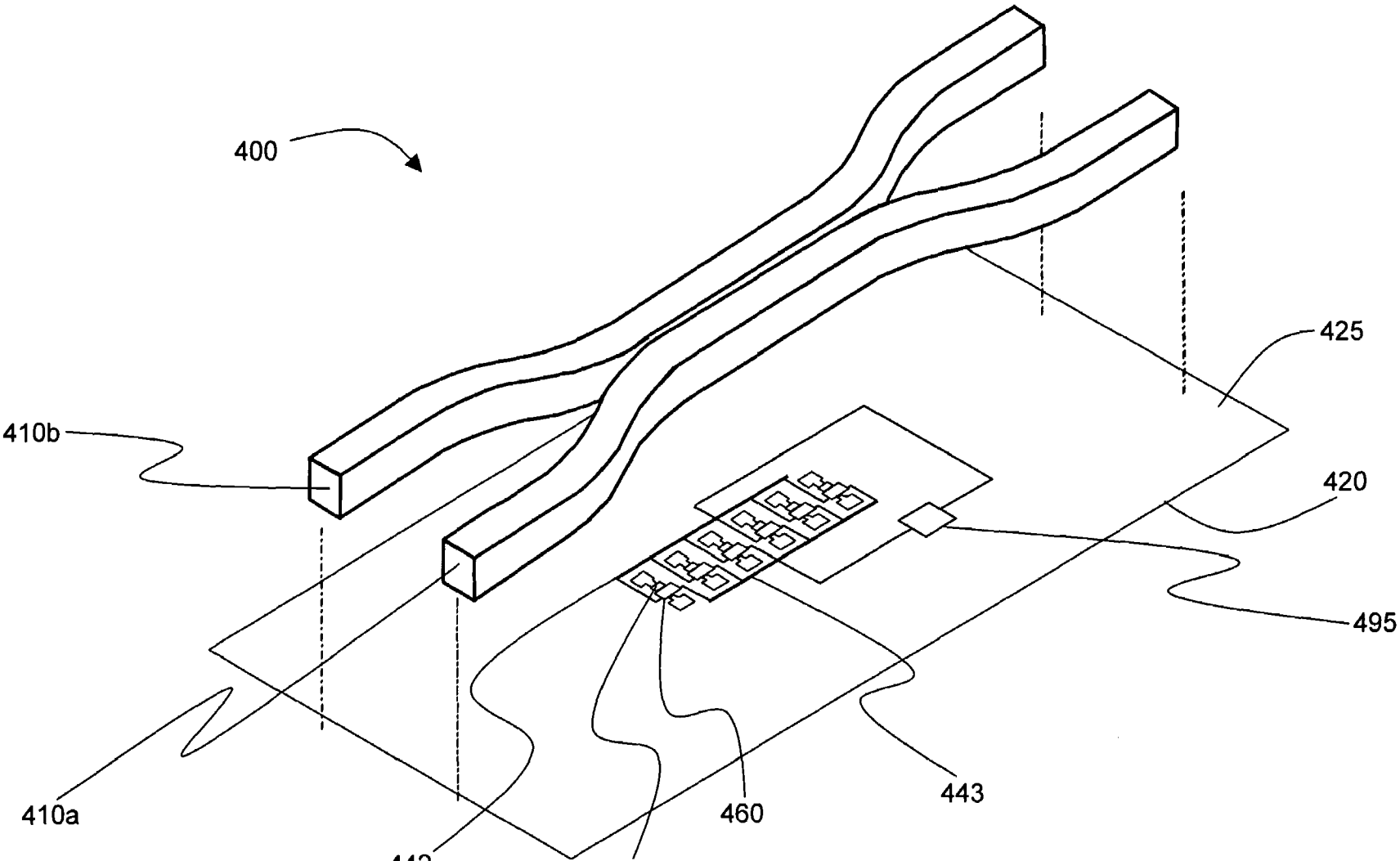
FIG. 4 shows an exploded perspective view of the an alternative embodiment of the image guide coupler switch.

FIG. 4 shows an exploded perspective view of the an alternative embodiment of the image guide coupler switch 400. In this embodiment, the dielectric waveguides 410*a* and 410*b* are attached directly on a monolithic circuit 430 which contains the switches 450 and capacitors 460. For illustration purposes, the waveguides 410*a* and 410*b* are shown lifted off the monolithic circuit 430. The back-side 420 of the substrate 425 may be metallized. This embodiment facilitates monolithic integration of other components, such as the RF power source, control logic, etc. Control logic shown as box 495 may be connected to the bias lines 442 and 443 for controlling the switches 450. The control logic 495 may be located on the substrate 425, or remote from the substrate, depending on the particular application.

Figure 6:
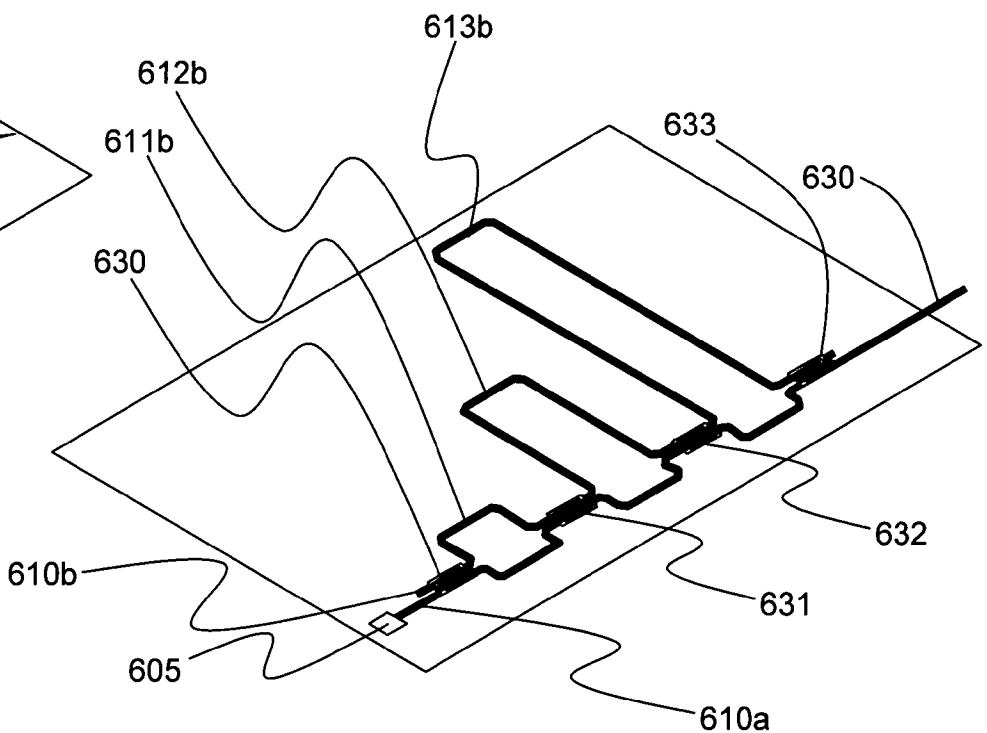
FIGS. 5 and 6 show possible examples of antenna feed structures that may utilize certain embodiments of the image guide coupler switch of the present invention.
Figure 5:
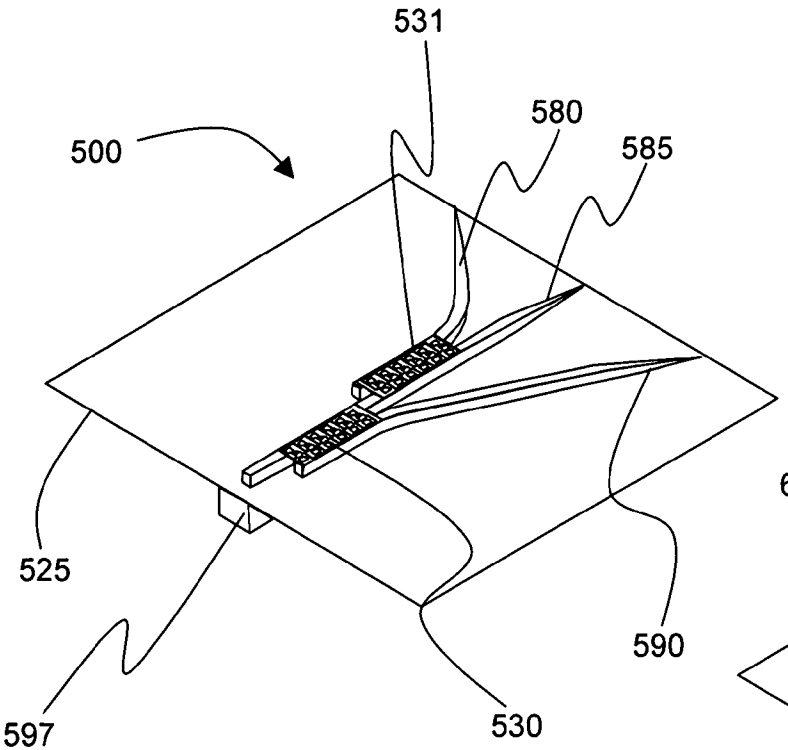

FIGS. 5 and 6 show possible examples of antenna feed structures that may utilize certain embodiments of the image guide coupler switch of the present invention. Shown in FIG. 5, a switched antenna beam structure 500 can radiate a signal in one of a number of directions. The signal is directed to the appropriate image guide radiator 580, 585, or 590 by a set of coupling control circuits 530 and 531. A receiver, a transmitter, or control circuit chip 597 is shown mounted to the back side of the substrate 525 In FIG. 6, a three-bit delay line phase shifter 600 is shown constructed utilizing four coupling control circuits 630-633 to add or remove delay lines 611*b*, 612*b*, or 613*b* in the waveguide 610*b*. A receiver chip 605 is shown adjacent the waveguide 610*a*. Although not shown, an RF source may used to launch the fundamental image guide propagating mode by known adapter techniques. Also, although a pointed radiating element 680 is shown, other types of image guide antennas could be used.

Different embodiments may be constructed for various wavelength signals. Some embodiments can readily be fabricated monolithically as a millimeter wave integrated circuits, as well as for submillimeter wave applications. Various embodiments may be used in millimeter wave systems such as phase shifters, switch networks, or beam steering. High frequency imaging and phased array antennas are some examples which could incorporate certain embodiments of the image guide coupler for collision avoidance radar, high resolution seekers, and broadband communication systems. High power applications are also possible as the coupling circuitry controls the coupling and is not itself handling the full signal power.

Having described this invention in connection with a number of embodiments, modification will now certainly suggest itself to those skilled in the art. As such, the invention is not limited to the disclosed embodiments, except as required by the appended claims.

What is claimed is:

1. A system comprising:

a) an antenna; and b) an antenna support structure comprising:

(i) a dielectric image guide coupler; and (ii) a coupling control circuit comprising:

(1) at least one field pick up probe extending adjacent the image guide coupler;

(2) a switch connected in series with the at least one field pick up probe and a dielectric waveguide of the dielectric waveguide image guide coupler; and (3) control logic electronics connected to the switch for controlling the switch.

2. The system of claim 1 further comprising a capacitor connected in series with the switch.

3. The system of claim 2 wherein the switch and the capacitor are connected between the at least one field pick up probe and a dielectric waveguide of the dielectric image guide coupler.

4. The system of claim 3 wherein the capacitor is connected between the at least one field pick up probe and a first waveguide of the dielectric image guide coupler, and wherein the switch is connected between the at least one field pick up probe and a second waveguide of the dielectric image guide coupler.

5. The system of claim 1 wherein the coupling control circuit comprises a pair of field pick up probes extending across the image guide coupler, and wherein the capacitor is series connected between the pair of field pick up probes, and wherein the switch is series connected between the pair of field pick up probes.

6. The system of claim 1 wherein the at least one field pick up probe is series connected between the capacitor and the switch.

7. The system of claim 1 further comprising:

a) an array of field pick up probes extending at least part way across the dielectric image guide coupler; and b) an array of switches, each switch being series connected with a corresponding field pick up probe of the array of field pick up probes.

8. The system of claim 7 further comprising an array of capacitors, each capacitor of the array of capacitors being series connected between a dielectric waveguide of the dielectric image guide coupler and a corresponding field pick up probe of the array of field pick up probes.

9. The system of claim 7 further comprising an array of capacitors, each capacitor of the array of capacitors being series connected with a corresponding switch of the array of switches between a corresponding field pick up probe and a dielectric waveguide of the dielectric image guide coupler.

10. A system comprising:

a) an antenna; and b) an antenna support structure comprising:

(i) waveguides having an active region for coupling electromagnetic radiation; and (ii) a coupling control circuit adjacent the active region, the coupling control circuit comprising:

(1) at least one field pick up probe adjacent the active region; and (2) a variable capacitor means connected in series with the at least one field pick up probe; and (iii) control logic electronics connected to the variable capacitor means.

11. The system of claim 10, wherein the variable capacitor means comprises at least one switch and series connected capacitor.

12. The system of claim 10, wherein the variable capacitor means comprises at least one varactor.

13. An image guide coupler comprising:

a) waveguides having an active region for coupling electromagnetic radiation; and b) a coupling control circuit adjacent the active region, the coupling control circuit comprising:

(i) at least one field pick up probe adjacent the active region; and (ii) a variable means for connecting capacitance in series with the at least one field pick up probe.

14. The image guide coupler of claim 13 further comprising an array of field pick up probes, and wherein the variable means comprises an array comprising switches and capacitors series connected with the array of field pick up probes.

15. The image guide coupler of claim 13, further comprising an array of field pick up probes, and wherein the variable means comprises an array of varactors series connected with the array of field pick up probes.

16. The image guide coupler of claim 13, wherein the variable means comprises at least one switch and at least one capacitor.

17. The image guide coupler of claim 13, wherein the variable means comprises at least one varactor.

18. A method for an image guide coupler, the method comprising controlling a coupling between adjacent waveguides of a propagating wave by controlling a coupling through at least one field pick up probe positioned next to the adjacent waveguides.

19. The method of claim 18, wherein controlling the coupling through the at least one field pick up probe comprises using a series connected switch.

20. The method of claim 18, wherein controlling the coupling through the at least one field pick up probe comprises using at least one of: (a) a pin diode; (b) a transistor; (c) a MEMS switch; or (d) a varactor, in series with the at least one field pick up probe.

21. The method of claim 18, wherein controlling coupling of at the least one field pick up probe comprises causing one of:

(a) an open circuit; or (b) a closed circuit, of the coupling through the at least one field pick up probe.

22. The method of claim 18, wherein controlling the coupling between adjacent waveguides comprises using an array of field pick up probes.

23. The method of claim 18, wherein controlling the coupling between adjacent waveguides comprises controlling a capacitance between the adjacent waveguides using the at least one field pick up probe.

24. The method of claim 23, wherein controlling a capacitance between the adjacent waveguides comprises switching a coupling state of the at least one field pick up probe having a series connected capacitance associated therewith.

25. The method of claim 24, wherein switching the coupling state comprises providing series connected switching of a capacitor in series with the at least one field pick up probe.

26. The method of claim 18, wherein controlling a coupling between adjacent waveguides comprises influencing a strength of coupling between the adjacent waveguides by coupling a capacitance in series with the field pick up probes.

27. The method of claim 26, wherein coupling a capacitance in series comprises controlling a switch connected in series with a capacitor.

28. The method of claim 26, wherein coupling a capacitance comprises using a series connected varactor.

29. The method of claim 18, wherein controlling the coupling between adjacent waveguides comprises controlling an RF current flow in the at least one field pick up probe.

30. The method of claim 29, wherein controlling the RF current flow in the at least one field pick up probe comprises switching a connection between the at least one field pick up probe and the adjacent waveguides.

31. The method of claim 29, wherein controlling the coupling of the at least one field pick up probe comprises using at least one of: (a) a pin diode; (b) a transistor; (c) a MEMS switch; or (d) a varactor, in series with the at least one field pick up probe.

32. A method for an image guide coupler for controlling a coupling between adjacent waveguides, the method comprising influencing a strength of the coupling between the adjacent waveguides at a coupling region by coupling a capacitance in series with at least one field pick up probe.

33. The method of claim 32, wherein coupling a capacitance comprises switching to connect a capacitor in series with the at least one field pick up probe.

34. The method of claim 32, wherein coupling a capacitance comprises using at least one of: (a) a pin diode; (b) a transistor; (c) a MEMS switch; or (d) a varactor, in series with the at least one field pick up probe.

35. The method of claim 32, wherein influencing the strength of the coupling between the adjacent waveguides at the coupling region comprises controlling an RF current flow in the at least one field pick up probe.

36. A method for an image guide coupler for controlling a coupling between waveguides, the method comprising controlling an RF current flow through at least one field pick up probe positioned adjacent an active region of the waveguides.

37. The method of claim 36, wherein controlling the RF current flow through the at least one field pick up probe comprises switching the current flow in the at least one field pick up probe.

38. The method of claim 36, wherein controlling the RF current flow through the at least one field pick up probe comprises using at least one of: (a) a pin diode; (b) a transistor; (c) a MEMS switch; or (d) a varactor, in series with the at least one field pick up probe.

* * * * *